US005842498A

United States Patent [19]

Locke et al.

[11] Patent Number: 5,842,498

[45] Date of Patent: Dec. 1, 1998

[54] MOUNTING ADAPTER AND ASSEMBLY FOR RENDERING FILL VALVES FOR TANK-TYPE INSTANTLY DISMOUNTABLE

[76] Inventors: Randal D. A. Locke; Daniel P. Dunbar; Teresa M. Locke, all of P.O. Box 1325, Redway, Calif. 95560-1325

[21] Appl. No.: 974,432

[22] Filed: Nov. 19, 1997

Related U.S. Application Data

[63] Continuation-in-part of Ser. No. 488,289, Jun. 7, 1995, Continuation-in-part of Ser. No. 488,292, Jun. 7, 1995, and a continuation-in-part of PCT/US96/10493, Jun. 7, 1996.

[51] Int. Cl.[6] ..... F16K 31/34; F16K 33/00

[52] U.S. Cl. ..... 137/315; 137/403; 137/414

[58] Field of Search ..... 137/403, 414, 137/315, 320, 448; 285/33, 396, 402; 251/148

[56] References Cited

U.S. PATENT DOCUMENTS

| | | | |
|---|---|---|---|
| 3,797,518 | 3/1974 | Holm et al. | 137/442 |
| 3,895,645 | 7/1975 | Johnson | 137/414 |
| 4,065,095 | 12/1977 | Johnson | 137/414 |
| 4,094,327 | 6/1978 | Brandelli | 137/426 |
| 4,100,928 | 7/1978 | Schoepe | 137/437 |
| 4,180,096 | 12/1979 | Johnson | 137/414 |
| 4,182,364 | 1/1980 | Gilbert et al. | 137/426 |
| 4,240,606 | 12/1980 | Johnson | 251/127 |
| 4,286,619 | 9/1981 | Straus | 137/426 |
| 4,562,859 | 1/1986 | Shames et al. | 137/430 |
| 4,735,230 | 4/1988 | Detloff | 137/426 |
| 4,765,363 | 8/1988 | Pi-Yu | 137/414 |
| 4,945,944 | 8/1990 | Chen | 137/426 |
| 5,035,257 | 7/1991 | Antunez | 137/426 |
| 5,211,204 | 5/1993 | Mikol | 137/426 |
| 5,287,882 | 2/1994 | Mikol | 137/426 |
| 5,598,865 | 2/1997 | Musso | 137/315 |

*Primary Examiner*—George L. Walton

*Attorney, Agent, or Firm*—Millen, White, Zelano & Branigan, P.C.

[57] ABSTRACT

Disclosed is a fill valve and mounting adapter assembly combination for tank-type toilets and the like which renders the fill valve internally and instantly mountable and dismountable without the necessity of separating the mounting adapter assembly from the tank and the water delivery line. The mounting adapter is T-shaped, hollow and provides water communication, when the adapter is mounted on the tank, through the interior of the adapter, between the water line and the interior of the tank and comprises an outwardly projecting circular platform on the upper end thereof having a lower surface with a hole in the center thereof and a circumferential circular vertical wall with a pair of inwardly projecting and opposing retention tabs at its upper end which tabs and the bottom wall and side wall of the platform form a recessed trough therein adapted to receive and seat a fill valve in the platform, which valve seats on a pair of o-ring seals providing a water tight seal between the fill valve and the mounting platform. A unitary axially positioned hollow shank portion in water tight communication with and projecting downwardly from the lower surface of the mounting platform has a threaded exterior adapted to seal in cooperation with mounting and connecting nuts the mounting assembly to the tank and to the water line. The fill valve is rendered instantly and digitally rotably mountable and dismountable from the tank of a tank-type toilet without disassembly of the mounting or connecting assemblies, which fill valve comprises a circular base having two opposing compression cams adapted to seat and seal the fill valve in the trough of the platform of the mounting adapter.

12 Claims, 2 Drawing Sheets

MOUNTING ADAPTER AND ASSEMBLY FOR RENDERING FILL VALVES FOR TANK-TYPE INSTANTLY DISMOUNTABLE

This is a continuation-in-part of U.S. applications Ser. No. 08/488,289 filed Jun. 7, 1995, 08/488,292 filed Jun. 7, 1995 and PCT application PCT/US96/10493 filed Jun. 7, 1996.

FIELD OF THE INVENTION

The present invention relates to improvements in automatic fill valves for controlling the water level in tank type-toilets and the like. More particularly, it relates to a combination of a diaphragm fill valve and a mounting adapter and mounting and connecting assemblies therefor which renders the fill valve digitally rotably and instantly mountable and dismountable without first separating the mounting adapter and its associated mounting and connecting assemblies from the tank or the water line. It also relates to the novel mounting adapter assembly employed in the combination of this invention.

BACKGROUND OF THE INVENTION

Diaphragm fill valves for filling and maintaining the water level in tanks and tank-type toilets are described in U.S. Pat. Nos. 4,240,606, 4,180,096, 4,065,095 and 3,895,645, whose disclosures are incorporated herein by reference.

Fill valves used in tank-type toilets are customarily mounted on the inner surface of the tank and the stem or lower portion of the valve projects downwardly through a hole in the bottom of the tank and is connected to the water line below the bottom of the tank. Faceted or serrated nuts and combinations of sealing gaskets and threaded or compression type fittings are used to connect and seal the fill valve to the bottom of the tank and the water line to the fill valve stem or lower portion. To replace the fill valve requires the steps of: turning off the water line; draining the tank; disconnecting the hardware which connects the fill valve to the water line; removing the hardware which mounts the valve to the tank; removing the existing fill valve; mounting the new or repaired valve on the tank; connecting the fill valve to the tank; connecting the fill valve to the water line; and opening the water line. Even if the fill valve can be repaired while mounted on the tank and still attached to the hardware connecting it, e.g. in the case of the diaphragm fill valve disclosed in the '606 and '096 patents cited above, it does not avoid the difficulties of accessibility, particularly in the traditional toilet tank, which make servicing the fill valve cramped and cumbersome. In addition, the skills and tools required to install or repair a fill valve are not possessed by the majority of toilet owners, whether domestic or commercial. As a result, many use professional plumbers who generally charge far more for repair or replacement of the fill valve than the typical cost of the fill valve itself.

Our prior U.S. Pat. No. 5,678,600, whose disclosure is incorporated herein by reference, discloses a fill valve for use in multipurpose water reservoirs, none of which relate to tank-type toilets and the like because the base of the fill valve cannot project through the hole conventionally present in the bottom of the tank of a toilet to enable it to be connected to the water line.

Surprisingly, fill valves for tank-type toilets have existed for over a century, yet to date only one, U.S. Pat. No. 5,598,865, discloses a "Quick Release Toilet Tank Valve." Unfortunately, the valve, its "quick release" mechanisms and the mounting assembly are archaic and have little apparent commercial value. The valve disclosed in the '865 patent is over ten times the height and size of the valve of the present invention as well as being of the traditional float type valve with all of the inherent negative failure characteristics associated with simple float valves. In particular the issues of reliability, consistent fill levels, cavitation and noise are not addressed by the '865 patent. The '865 patent discloses the use of "standard garden hose quick release connecters" and other traditional and existing mechanisms, all of which, particularly in the case of garden hose connectors, are notoriously prone to failure. In contradistinction the present invention discloses a valve and its related mounting and connecting assemblies that is instantly mountable and dismountable as well as being reliable, compact and commercially viable. The present invention provides a method and mounting assembly which enables the fill valve of our prior U.S. Pat. No. 5,678,600 to be instantly dismountable and mountable in the tank of a tank-type toilet.

OBJECTS OF THE INVENTION

It is the object of the present invention to provide a novel fill valve and mounting and connecting assembly combination for tanks and tank-type toilets which enables the fill valve to be manually and easily dismounted in seconds without water spillage or tools, and to be easily and manually replaced, even by unskilled persons unfamiliar or inexperienced with plumbing or fill valves. Another object is to provide a reliable and manually serviceable mounting adapter assembly for rendering the fill valve of U.S. Pat. No. 5,678,600 usable as a fill valve for tanks and tank-type toilets. Other objects will be apparent to those skilled in the art to which this invention pertains.

SUMMARY OF THE INVENTION

In one aspect, this invention relates to a combination of a diaphragm fill valve and a mounting assembly which renders the fill valve digitally instantly mountable and dismountable, i.e., manually without the necessity of tools from within the tank of a conventional tank-type toilet and the like having a hole in the bottom of the tank thereof for connecting the fill valve to a mounting assembly and adapted to be coupled to a water line delivering water to the tank, wherein the mounting assembly comprises a mounting adapter which has a circular upper end adapted to be mounted onto the inner surface of the bottom of the tank and friction sealed thereto and a lower end adapted to be fitted through the hole in the bottom of the tank and connected to the water line; first sealing means for providing a water tight connection between the top of the mounting adapter and the fill valve; and second sealing means for providing water tight connection between the mounting adapter and the tank. The mounting adapter comprises an outwardly projecting circular mounting platform on the upper end thereof having a lower surface with a hole in the center thereof; a circumferential circular vertical side wall with a pair of inwardly projecting and opposing retention tabs at its upper end, which tabs and the bottom wall and side wall of the platform form a recessed trough therein adapted to receive and seat a fill valve in the platform; which mounting platform further comprises a unitary axially positioned hollow shank portion in water tight communication with and projecting downwardly from the lower surface of the mounting platform and adapted to be inserted from the interior of the tank through the bottom thereof and having a threaded exterior adapted to seal in cooperation with the second sealing means the mounting adapter to the tank; and a diaphragm fill valve which in a single motion is digitally instantly rotably mountable and dismountable from the mounting adapter without disassembly the mounting assembly and comprises a circular base having two opposing compression cams adapted to seat and seal the fill valve in the trough of the platform of the mounting adapter.

In another aspect, this invention relates to the combination of this invention in further combination with a connecting assembly for coupling the mounting adapter to the water line, which connecting assembly comprises; an internally threaded hollow connecting nut threadably mountable on the lower end of the projecting shank portion which includes a flanged end which functions through the agency of a washer in the connecting nut to deform a cone washer into sealing engagement between the water line and the outermost end of the projecting shank portion.

In a method of use aspect, this invention relates to a method of rendering the fill valve of U.S. Pat. No. 5,678,600 adaptable to a tank-type toilet or the like having a hole in the bottom of the tank thereof which provides water communication to a water supply line. The valve is rendered internally and instantly mountable and dismountable, without the necessity of separating the water line from the tank, which installation comprises the steps of:

a. installing the air and water sealing seals in the seal troughs located on the upper surface of the mounting platform;

b. sliding the gasket upwardly over the connection adapter stem until it meets the underside of the mounting platform;

c. mounting in the hole in the bottom of the tank or toilet tank the adapter which is T-shaped, hollow and provides water communication, when the adapter is mounted on the tank, through the interior of the adapter, between the water line, the valve, and the interior of the tank;

d. watertight connecting the downwardly projecting shank portion of the adapter to the water line;

e. mounting on the thus seated and connected mounting adapter a fill valve which in a single motion is instantly and digitally rotably mountable and dismountable from a tank or the tank of a tank-type toilet without disassembly, which fill valve comprises a circular base having two opposing compression cams adapted to seat and seal the fill valve in the trough of the platform of the mounting adapter.

DESCRIPTION OF THE PREFERRED EMBODIMENT OF THE INVENTION

In a preferred product embodiment, the fill valve is a diaphragm fill valve of U.S. Pat. No. 5,678,600 in which the diaphragm fill valve comprises water and gas inlet ports positioned above the seal formed between the valve and the mounting platform when the former is mounted on the latter; the water inlet port is positioned in the center of the bottom of the valve and is adapted to provide water communication to the valve with the water from the water line after it has passed through the mounting assembly; and the gas inlet port of the valve is positioned in the bottom of the valve, axially offset between the hole in the center of the bottom of the valve and the circumference thereof, in communication with the slot in the threaded portion of the mounting assembly comprising; a slot in the threaded portion thereof which provides gas communication between the fill valve and the exterior of tank. Preferably, the means for sealing the mounting assembly to the tank comprises a first threaded mounting nut threadably mountable onto the adapter to seal the adapter to the tank and a second threaded connecting nut adapted to connect the adapter in watertight connection to a water line providing water to the toilet tank.

Figure 1:
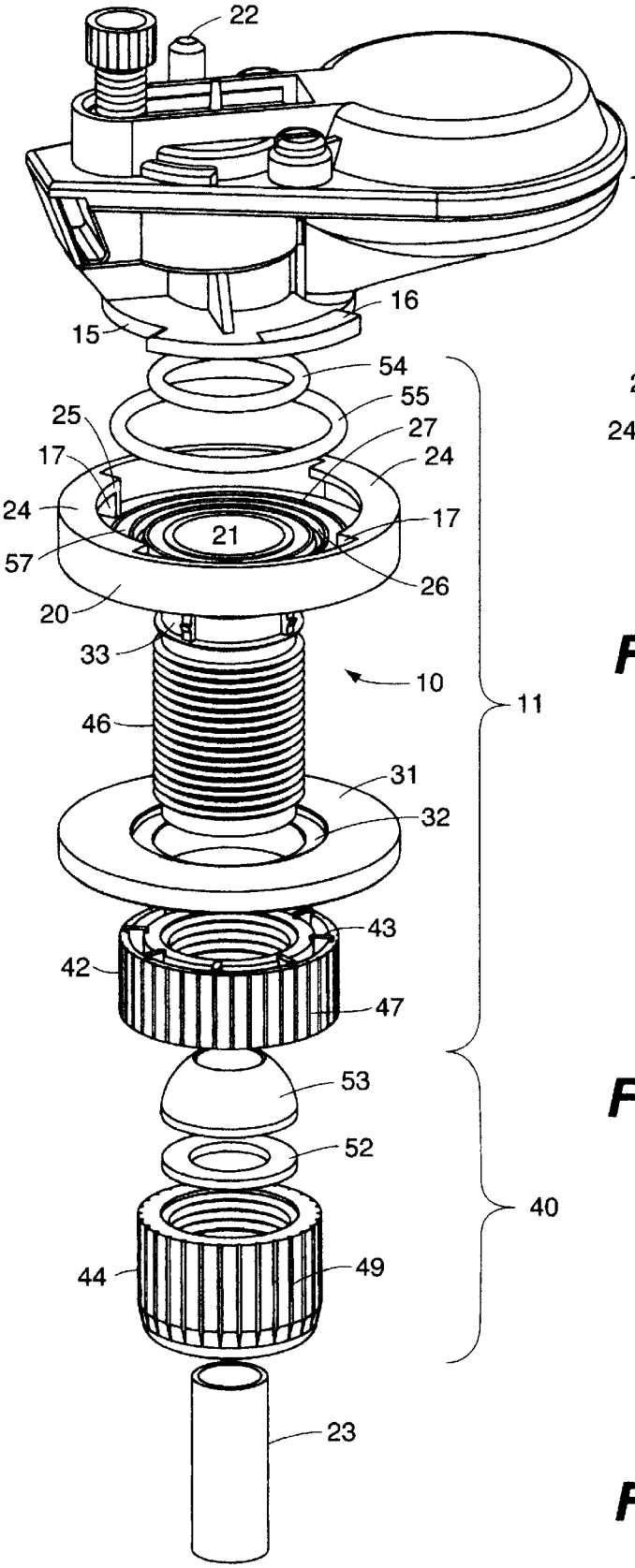
FIG. 1 is a perspective exploded view of a fill valve, connection adapter and mounting assembly, embodying the features of the present invention.
Figure 2:
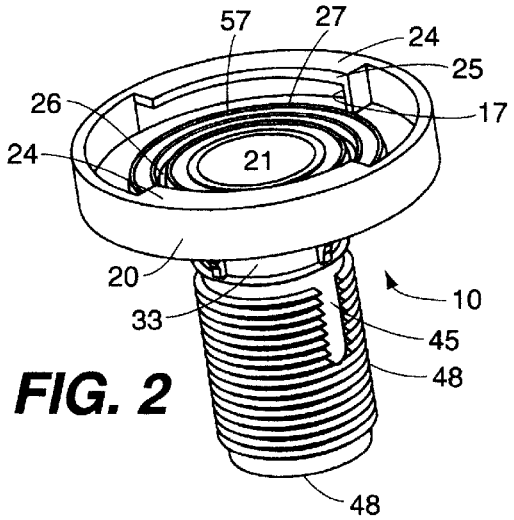
FIG. 2 is a perspective view of the mounting adapter shown in FIG. 1.
Figure 3:
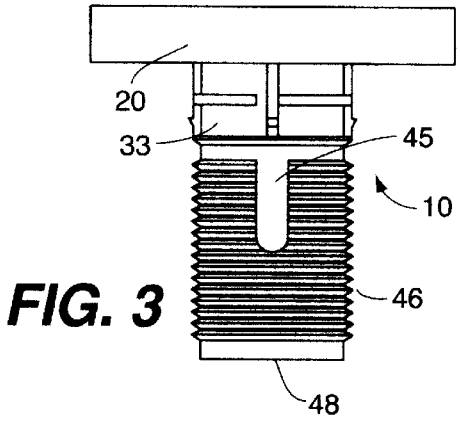
FIG. 3 is a side view of the right side of the mounting adapter shown in FIGS. 1 and 2.
Figure 4:
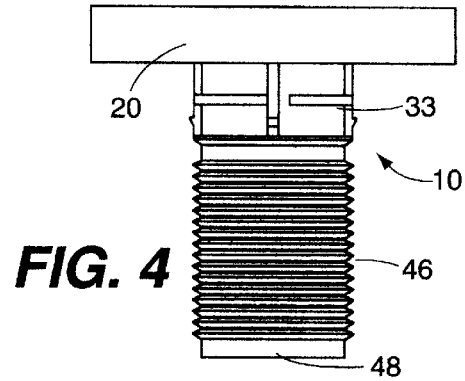
FIG. 4 is a side view of the left side of the mounting adapter shown in FIGS. 1–3.
Figure 5:
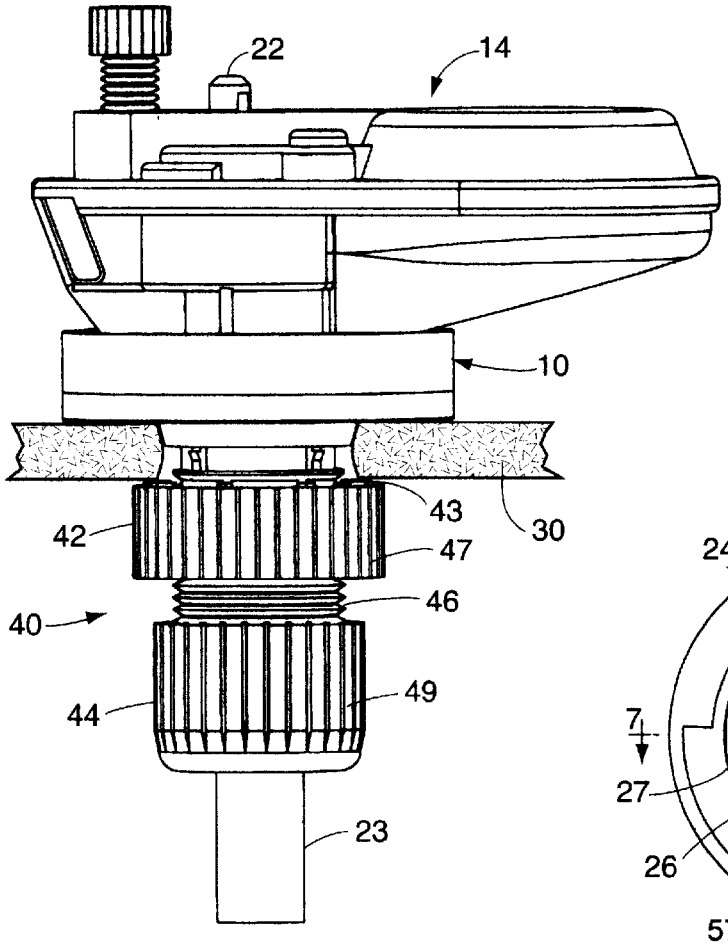
FIG. 5 is a side view of the assembled fill valve, mounting adapter and mounting assembly shown in FIG. 1.
Figure 6:
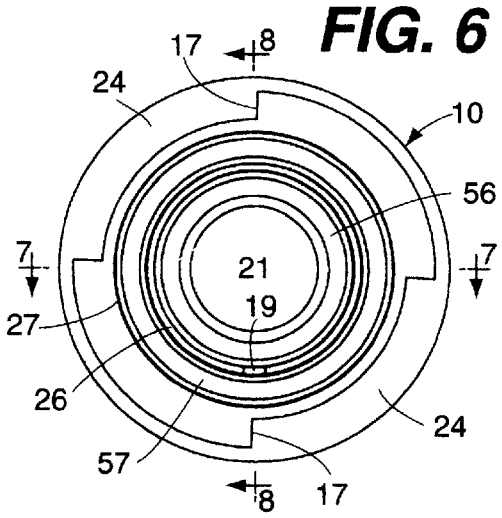
FIG. 6 is a top view of the mounting adapter as shown in FIGS. 1–5.
Figure 7:
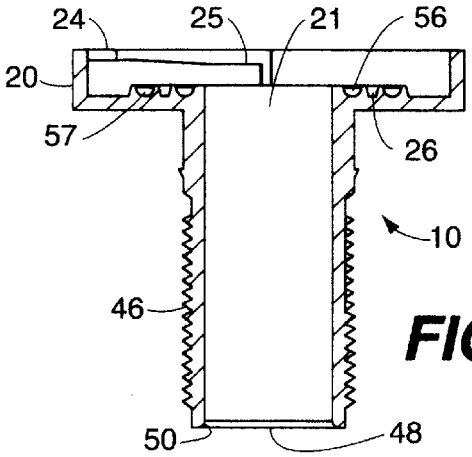
FIG. 7 is a vertical sectional view taken along the line 7—7 of FIG. 6.
Figure 8:
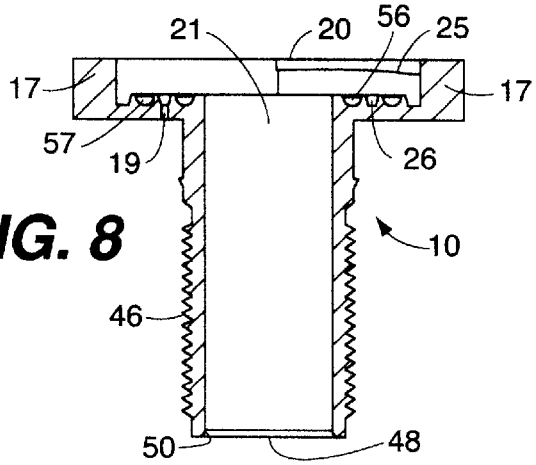
FIG. 8 is a vertical sectional view taken along the line 8—8 of FIG. 6.

The fill valve and the modified valve mounting adapter of the present invention shown in FIGS. 1 through 8 are functionally and structurally similar to a fill valve and valve mounting seat designed for use in multipurpose water reservoirs disclosed in U.S. Pat. No. 5,678,600.

The lower portion of the connection apparatus of the present invention shown in FIGS. 1 through 8 is functionally and structurally similar to the connection apparatus of the fill valve for use in toilets and other tanks disclosed in U.S. Pat. Nos. 4,345,619, 4,240,606, 4,180,096, 4,065,095 and 3,895,645, whose disclosure is incorporated herein by reference.

In brief, the objects and advantages of the present invention including those discussed above are achieved through the provision of a fill valve 14 including a housing, positioned within a tank 30 and having a water inlet port 21 and an outlet port 22. The valve is movable between open and closed positions to permit and prevent the flow of water into the tank. An adjustable sensing device detects the level of water in the tank and a control assembly coupled between the sensing device and the valve opens the valve if the water level is below the predetermined level.

With reference now to FIGS. 1 through 8 of the accompanying drawings, there is illustrated a mounting adapter constructed in accordance with the principles of the present invention and designated as a whole by the reference numeral 10. The mounting adapter 10 includes a circular mounting platform 20 adapted to accept and seal the fill valve 14. A water isolating seal 54 and an air isolating seal 55 are placed, respectively, in the water seal trough 56 and the air seal trough 57. The fill valve 14 twists into the mounting platform 20 by slipping down past the retention tabs 24 (two each opposing) and twisting clockwise approximately 90 degrees until the retention tab compression cams 25 (two each opposing) on the valve base 15 and the valve base compression cams 16 (two each opposing) engage, forcing the valve downward until the retention tab stops 17 (two each opposing) stop the fill valve 14 rotation. The downward force exerted during insertion of the valve 14 by the twin opposing valve base compression cams 16 and the retention tab compression cams 25, compresses both the air isolating seal 55 and the smaller diameter water isolating seal 56 downward and outward into the elevated seal retention walls 27 that surround the internal and external perimeters of both seals 55 and 56 and between which is created the air trough 26. The air trough 26 is an encircling trough that prevents water on either side of the seals from entering the air trough 26, allowing ambient air portage even in the event of incomplete insertion and positioning of the fill valve 14. Due to the central axis location of the water supply conduit 23 and the opposing water inlet port 21 of the fill valve 14, the delivery of water is unaffected by the position of the fill valve 14. The valve 14 will operate when installed in either of the two possible insertion positions.

Extending downward from the center of the mounting platform 20 there is provided a mounting assembly generally designated by the reference numeral 11 for mounting the mounting adapter 10 to the tank wall 30. There is also provided a connecting assembly generally designated by the reference numeral 40 for coupling the water inlet port 21 to the water line 23. The mounting assembly 11 and the connecting assembly 40 are capable of installation and assembly without the use of tools, and accommodate tank walls of various thicknesses, yet are compact assemblies adaptable to various inlet pipe configurations.

More specifically, the mounting assembly 11 and the connecting assembly 40 include a mounting nut 42 and a connecting nut 44 each having internal threads and received on external threads provided on the projecting shank portion 46 within which is located the adapter water inlet 48. The gasket 31 is slipped over and up the projecting shank portion 46 until it is flush with the underside of the mounting platform 20, which combination is then positioned into and through the hole in the tank wall 30. Proceeding to the underside of the tank wall 30, the mounting nut 42 is threaded first onto the projecting shank portion 46 until its innermost end engages the tank wall 30 in order to mount the mounting adapter 10 in position and to effect a seal between the mounting platform 20 and the tank wall 30 with the gasket 31 compressed on the interior tank wall 30. A circumferential notch 32 on the interior upper surface of the gasket 31 allows air to travel through the platform air vent 19, under the mounting platform 20 and enter the air flow pathway 32. The mounting nut 42 is provided with a number of spaced apart elevated projections 43 permitting air flow between the projections 43 and the tank wall 30 and completing the air flow pathway 33 for venting air from the fill valve 14 to the atmosphere. A parallel flow path is defined by a slot 45 in the threads of the projecting shank portion 46 so that venting is accomplished reliably even if one or the other of the parallel paths is blocked through the improper use of pipe joining compound or other material.

The connecting nut 44 is threaded onto the projecting shank portion 46 after installation of the mounting nut 42, and includes a flanged end 50 which functions through the agency of a washer 52 to deform a cone washer 53 into sealing engagement between the water line 23 and the outermost end of the projecting shank portion 46. Both nuts 42 and 44 can be hand tightened without the use of tools. Hand tightening is facilitated by providing serrations 47 and 49 on the circular outer peripheries of the nuts 42 and 44. Hand tightening of the nuts 42 and 44 prevents possible damage to the tank wall 30 and/or the mounting adapter 10 upon installation, and renders installation of the fill valve 14 convenient, even when the mounting adapter 10 is installed by the user rather than a contracted professional or tradesman.

Contemplated equivalence of the novel combination of this invention are corresponding combinations adapted to be fitted into a water reservoir, e.g., a reservoir used to water cattle or other animals, in which the water enters the reservoir through a hole in the side wall thereof and the adapter portion of the combination has an elbow middle portion which positions the mounting platform vertically and in an upright position.

LIST OF REFERENCE NUMBERS

10 Mounting adapter
11 Mounting assembly
14 Fill valve
15 Valve base
16 Valve base compression cam
17 Retention tab stops
19 Platform air vent
20 Mounting platform
21 Water inlet port
22 Outlet port
23 Water line
24 Retention tabs
25 Retention tab compression cams
26 Air trough
27 Seal retention walls
30 Tank/tank wall
31 Gasket
32 Circumferential slot
33 Air flow pathway
40 Connecting assembly
42 Mounting nut
43 Projections
44 Connecting nut
45 Slot
46 Projecting shank portion
47 Connecting nut serrations
48 Adapter water inlet
49 Mounting nut serrations
50 Flanged end
52 Washer
53 Cone washer
54 Water isolating seal
55 Air isolating seal
56 Water seal trough
57 Air seal trough It is claimed:

1. A combination of a diaphragm fill valve and a mounting assembly which renders the fill valve instantly mountable and dismountable from within the tank of a conventional tank-type toilet and the like having a hole in the bottom of the tank thereof for connecting the fill valve to a mounting assembly and adapted to be coupled for connecting the fill valve to a mounting assembly and adapted to be coupled to a water line delivering water to the tank, wherein:

a. the mounting assembly comprises a mounting adapter which has a circular upper end adapted to be mounted onto the inner surface of the bottom of the tank and friction sealed thereto and a lower end adapted to be fitted through the hole in the bottom of the tank and connected to the water line; first sealing means for providing a water tight connection between the top of the mounting adapter and the fill valve; and second sealing means for providing water tight connection between the mounting adapter and the tank; and the mounting adapter comprises:

(i) an outwardly projecting circular mounting platform on the upper end thereof having a lower surface with a hole in the center thereof; a circumferential circular vertical wall with a p of inwardly projecting and opposing retention tabs at its upper end, which tabs and the bottom wall and side wall of the platform form a recessed trough therein adapted to receive and seat a fill valve in the platform;

(ii) a unitary axially positioned hollow shank portion in water tight communication with and projecting downwardly from the lower surface of the mounting platform and adapted to be inserted from the interior of the tank through the bottom thereof and having a threaded exterior adapted to seal in cooperation with the second sealing means the mounting adapter to the tank; and b. the diaphragm fill valve is in a single motion digitally instantly rotably mountable and dismountable without the use of tools without dismounting the mounting assembly and comprises a circular base having two opposing compression cams adapted to seat and seal the fill valve in the trough of the platform of the mounting adapter.

2. A combination of claim 1, wherein the mounting adapter has a hole through the mounting platform thereof and an air flow pathway and air slot in the threaded portion thereof which provides gas communication between the exterior of tank and the fill valve and wherein the fill valve comprises water and gas inlet ports positioned above the seal formed between the valve and the mounting platform when the former is mounted on the latter; the water inlet port is positioned in the center of the bottom of the valve and is adapted to provide water communication between the fill valve and the water line; and the gas inlet port of the fill valve is positioned in the bottom of the fill valve, axially offset between the hole in the center of the bottom of the fill valve and the circumference thereof, in communication with an air flow pathway in the lower end of the mounting assembly.

3. A tank-type flush toilet comprising a water reservoir tank and toilet bowl in which the tank is connected via a flush valve to the toilet bowl and connected via the diaphragm fill valve and mounting assembly according to claim 2 mounted in a hole in the bottom of the tank to a source of water under pressure.

4. A combination of claim 1, wherein the second sealing means for sealing the mounting assembly to the tank comprises a threaded mounting nut threadably mountable onto the mounting adapter and a circular sealing gasket adapted with a circumferential slot on the upper interior edge to seal the mounting adapter to the tank and provide a circumferential pathway for ambient air communication between the fill valve and the air flow pathway.

5. A tank-type flush toilet comprising a water reservoir tank and toilet bowl in which the tank is connected via a flush valve to the toilet bowl and connected via the combination of a diaphragm fill valve and mounting assembly according to claim 3 mounted in a hole in the bottom of the tank to a source of water under pressure.

6. A combination of claim 1, wherein the adapter has a slot in the threaded portion thereof which provides gas communication between the fill valve and the exterior of tank and the diaphragm fill valve comprises water and gas inlet ports positioned above the seal formed between the valve and the mounting platform when the former is mounted on the latter; the water inlet port is positioned in the center of the bottom of the valve and is adapted to provide water communication to the valve with the water from the water line after it has passed through the mounting assembly; and the gas inlet port of the valve is positioned in the bottom of the valve, axially offset between the hole in the center of the bottom of the valve and the circumference thereof, in communication with the air flow pathway and the air slot in the threaded portion of the mounting assembly; and wherein the means for sealing the mounting assembly to the tank comprises a first threaded mounting nut threadably mountable onto the adapter to seal the adapter to the tank and a second threaded connecting nut adapted to connect the adapter in watertight connection to a water line providing water to the toilet tank.

7. A tank-type flush toilet comprising a water reservoir tank and toilet bowl in which the tank is connected via a flush valve to the toilet bowl and connected via the combination of the diaphragm fill valve and mounting assembly combination according to claim 4 mounted in a hole in the bottom of the tank to a source of water under pressure.

8. A combination of claim 1, further comprising a connecting assembly for coupling the mounting adapter to the water line, which connecting assembly comprises an internally threaded hollow connecting nut threadably mountable on the lower end of the projecting shank portion which includes a flanged end which functions through the agency of a washer in the connecting nut to deform a cone washer into sealing engagement between the water line and the outermost end of the projecting shank portion.

9. A tank-type flush toilet comprising a water reservoir tank and toilet bowl in which the tank is connected via a flush valve to the toilet bowl and connected via the combination of the diaphragm fill valve and mounting assembly combination according to claim 5 mounted in a hole in the bottom of the tank to a source of water under pressure.

10. A combination of claim 1, wherein the adapter has a slot in the threaded portion thereof which provides gas communication between the fill valve and the exterior of tank and the diaphragm fill valve comprises water and gas inlet ports positioned above the seal formed between the valve and the mounting platform when the former is mounted on the latter; the water inlet port is positioned in the center of the bottom of the valve and is adapted to provide water communication to the valve with the water from the water line after it has passed through the mounting assembly; and the gas inlet port of the valve is positioned in the bottom of the valve, axially offset between the hole in the center of the bottom of the valve and the circumference thereof, in communication with the air flow pathway and the air slot in the threaded portion of the mounting assembly; and wherein the means for sealing the mounting assembly to the tank comprises a first threaded mounting nut threadably mountable onto the adapter to seal the adapter to the tank; and further comprises a connecting assembly for coupling the mounting adapter to the water line, which connecting assembly comprises; an internally threaded hollow connecting nut threadably mountable on the lower end of the projecting shank portion which includes a flanged end which functions through the agency of a washer in the connecting nut to deform a cone washer into sealing engagement between the water line and the outermost end of the projecting shank portion.

11. A tank-type flush toilet comprising a water reservoir tank and toilet bowl in which the tank is connected via a flush valve to the toilet bowl and connected via the combination of the diaphragm fill valve and mounting assembly combination according to claim 6 mounted in a hole in the bottom of the tank to a source of water under pressure.

12. A tank-type flush toilet comprising a water reservoir tank and toilet bowl in which the tank is connected via a flush valve to the toilet bowl and connected via the diaphragm fill valve and mounting assembly combination according to claim 1 mounted in a hole in the bottom of the tank to a source of water under pressure.

* * * * *